United States Patent [19]

Kose et al.

[11] Patent Number: 4,841,321

[45] Date of Patent: Jun. 20, 1989

[54] CIRCULATING LIQUID FLOW DETECTING APPARATUS IN A MACHINE FOR AUTOMATICALLY PROCESSING LIGHT-SENSITIVE MATERIAL

[75] Inventors: Junichi Kose; Nobuyuki Seto, both of Kanagawa, Japan

[73] Assignee: Fuji Photo Film Co., Ltd., Kanagawa, Japan

[21] Appl. No.: 190,430

[22] Filed: May 5, 1988

[30] Foreign Application Priority Data

| | | | |
|---|---|---|---|
| May 7, 1987 | [JP] | Japan | 62-109684 |
| May 7, 1987 | [JP] | Japan | 62-109685 |
| Sep. 17, 1987 | [JP] | Japan | 62-231111 |
| Sep. 17, 1987 | [JP] | Japan | 62-231112 |

[51] Int. Cl.[4] ..... G03D 3/06

[52] U.S. Cl. ..... 354/324; 137/392

[58] Field of Search ..... 354/297, 298, 324; 137/392; 417/36

[56] References Cited

U.S. PATENT DOCUMENTS

| | | | |
|---|---|---|---|
| 4,480,901 | 11/1984 | Osegowitsch et al. | 354/324 |
| 4,688,917 | 8/1987 | Muller et al. | 354/324 |

*Primary Examiner*—A. A. Mathews

*Attorney, Agent, or Firm*—Sughrue, Mion, Zinn, Macpeak & Seas

[57] ABSTRACT

An apparatus for detecting circulating liquid flow in a machine for automatically processing a photographic light-sensitive material is disclosed in which a branch pipe opened at a position higher than a liquid level of a processing liquid is vertically provided on the suction side of a circulating pump of a processing liquid circulating system provided outside a processing tank for circulating the processing liquid in the processing tank. A liquid level detecting electrode is provided in said opening portion so that the lower end of the electrode is positioned on the same level as or a position a little lower than the liquid level of the processing tank. A contact electrode is provided so as to be in contact with the processing liquid.

10 Claims, 4 Drawing Sheets

CIRCULATING LIQUID FLOW DETECTING APPARATUS IN A MACHINE FOR AUTOMATICALLY PROCESSING LIGHT-SENSITIVE MATERIAL

BACKGROUND OF THE INVENTION

The present invention relates to an apparatus for detecting circulating liquid flow of a processing tank in a machine for automatically processing a photographic light-sensitive element.

Machines for automatically processing photographic light-sensitive material (hereinafter sometimes referred to as "automatic processing machines") are arranged in various ways in accordance with the kind of light-sensitive material. For example, in the automatic developing machine, a black-and-white developing tank, a fixing tank, and a water-washing tank are provided in the case of a black-and-white photographic light-sensitive material, while a coloring developing tank, a decoloring tank, a fixing (or bleach fixing) tank, and a water-washing or fixing tank are provided in the case of a color photographic light-sensitive material. Then, an image-exposed light-sensitive material is successively led into the above-mentioned various processing tanks, processed in the processing tanks, and then discharged after being dried.

Further, in an automatic processing machine, when processing of a light-sensitive material has been completed, the activity of the processing liquids is reduced. In order to recover the, processing liquids, generally, a system is used in which the processing tanks are provided with replenishing liquid tanks for replenishing the processing liquids respectively, so that when light-sensitive materials are led into the automatic processing machine, the replenishing liquids are supplied in accordance with the quantity of the light-sensitive materials. Further, in order to equalize the compositions of the processing liquids or temperature distribution of the processing liquids in the respective processing tanks, circulating pumps for circulating and stirring the processing liquids are provided outside the respective processing tanks.

Recently, as the time required for processing the photographic material has become shorter, a processing temperature is made high to about 25° C.–40° C. so that the time taken for processing by the processing liquid is made short. In order to raise the temperature of the processing liquid to a predetermined value, a heater is provided in a processing tank, or heating means such as a heat exchanger, a heater, or the like is provided in a path of a circulating system by means of the above-mentioned circulating pump.

In the latter system, generally, the processing liquid is sucked by the circulating pump from a lower portion or a bottom portion of the processing tank, heated to a predetermined temperature, and then returned into the processing tank. In this case, however, precipitation in the processing tank often blocks the circulating piping system or the circulating pump, or the circulation is often stopped or weakened owing to a malfunction of the pump or the like, so that the temperature of the treatment liquid cannot be raised to the predetermined value, or the mixing of the processing liquid becomes insufficient to give significant influence to the processing. Conventionally, however, there has been no simple device or system for automatically detecting such a malfunction in the circulating system.

SUMMARY OF THE INVENTION

An object of the present invention is to provide an apparatus in which the above-mentioned circulating processing liquid can be automatically detected.

According to the present invention, the apparatus for detecting circulating liquid flow in a machine for automatically processing a photographic light-sensitive material is characterized in that a branch pipe opened at a position higher than a liquid level of a processing liquid is vertically provided on the suction side of a circulating pump of a processing liquid circulating system provided outside a processing tank for circulating a part of the processing liquid in the processing tank, a first liquid level detecting electrode is provided in the opening portion so that the lower end of the first electrode is positioned on the same level as or a position a little lower than the liquid level of the processing tank, a second liquid level detecting electrode is provided so that the lower end of the second electrode is positioned on the same level as or a little lower than a position where the liquid level in the branch pipe is lowered when the circulating pump is driven, and a common electrode is provided so as to be in contact with the processing liquid.

According to another aspect of the present invention, the apparatus for detecting circulating liquid flow in a machine for automatically processing a photographic light-sensitive material is characterized in that a branch pipe opened at a position higher than a liquid level of a processing liquid is vertically provided on the suction side of a circulating pump of a processing liquid circulating system provided outside a processing tank for circulating the processing liquid in said processing tank, a liquid level detecting electrode is provided in said opening portion so that the lower end of said electrode is positioned on the same level as or a position a little lower than the liquid level of said processing tank, and a contact electrode is provided so as to be in contact with the processing liquid.

The present invention can be applied not only to a processing liquid temperature adjusting system in an automatic processing machine for processing a photographic light-sensitive material such as X-ray film, general black-and-white film, color film, black-and-white printing paper, color printing paper, or the like, but to a circulating system for circulating a processing liquid for a light-sensitive printing material such as a PS (presensitized) plate or the like.

DESCRIPTION OF THE PREFERRED EMBODIMENTS

Figure 1A:
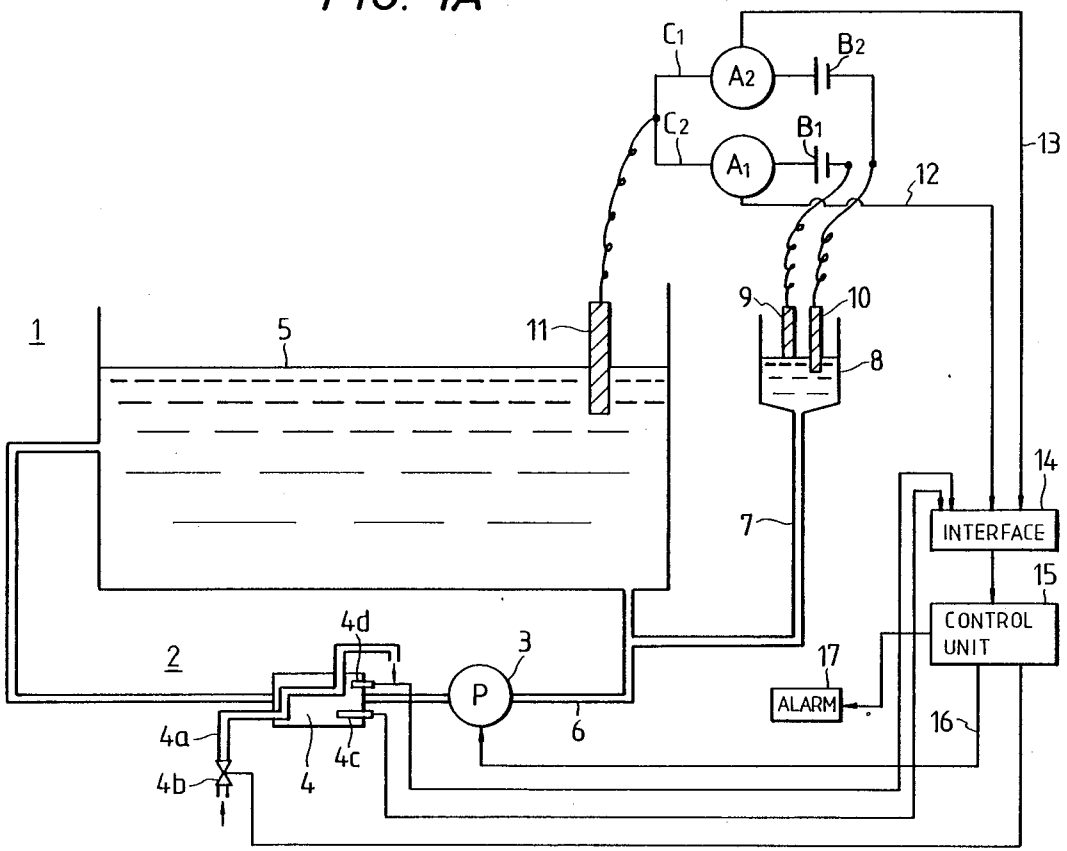
FIGS. 1, 3, 4 and 6 are schematic views showing a processing tank of an automatic processing machine to which the present invention is applied.

Referring to the drawings, embodiments of the present invention will be described hereunder.

FIG. 1 is a schematic view showing one of processing tanks, for example, a developing tank 1, of an automatic processing machine according to a first embodiment of the invention.

As shown in the drawing, a circulating system 2 is provided so as to connect a bottom portion to a side wall of the developing tank 1. A developer is sucked by a circulating pump 3 provided in the circulating system 2, passed through a heating means 4 (for example, a heater, a heat exchanger, or the like) to be heated so as to keep the developer 5 in the developing tank 1 at a desired temperature (for example, 25° C.–40° C.), and caused to flow into the developing tank from the side wall or an upper portion of the tank 1.

In the heating means 4, a cooling means **4*a*, such as a water supplying pipe connected to a water faucet may be installed in the heating means so as to keep the developing solution at a predetermined temperature. The water supply pipe is provided with a valve 4*b*** connected to a control unit via an interface.

In addition, in the heating means 4, a heater **4*c* and a temperature detecting sensor 4*d*** which are connected to the control unit via the interface.

According to the present invention, a branch pipe 7 opened slightly above the level of the developer is vertically provided on a pipe 6 provided on the upstream side through which the developer in the circulating system enters the pump 3 (that is, a suction side pipe). Preferably the diameter of an opening portion 8 of the branch pipe 7 is enlarged. A first level detecting electrode 9 is provided in the opening portion 8 so that the lower end of the electrode 9 is positioned in the same plane as or slightly lower than the liquid level in the developing tank 1. A second level detecting electrode 10 is provided in the opening portion 8 so that the lower end of the electrode 10 comes into contact with the liquid surface in the position where the liquid level in the branch pipe is lowered when the circulating pump 3 is actuated to suck the liquid, and a common electrode 11 is provided so that the lower end of the electrode 11 is immersed into the developer. The first level detecting electrode 9 and the common electrode 11, and the second level detecting electrode 10 and the common electrode 11 are separately connected to power sources $B_1$ and $B_2$ so as to form a first circuit $C_1$ and a second circuit $C_2$, respectively.

Figure 2A:
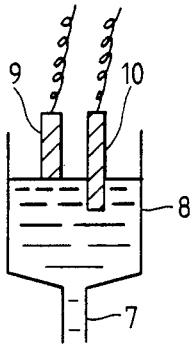
FIGS. 2A, 2B, 2C, 5A and 5B are views for explaining the relation between the processing liquid level at the opening portion of a branch pipe and electrode according to the present invention.

When the liquid level is normal in the state in which the circulating pump 3 is at rest, the level of the developer in the branch path 7 is even with the level of the developer in the developing tank, and the first electrode 9 and the second electrode 10 are in contact with the developer as shown in FIG. 2A, so that each of the first and second circuits $C_1$ and $C_2$ is in an on-state. In the case where liquid level is lowered because of insufficiency of a replenishing liquid, only the first circuit, or both the first and second circuits $C_1$ and $C_2$ are not turned on when the circulating pump is turned off.

Figure 2B:
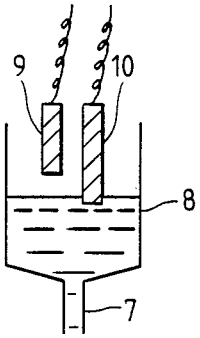

When the circulating pump 3 is driven to circulate the developer through the circulating system 2 so that the developer is heated by the heating means 4 to be kept at a predetermined temperature and then poured into the developing tank 1 to begin circulation, the level of the developer in the branch pipe 7 is lowered by the sucking operation of the circulating pump 3 to a state as shown in FIG. 2B in which the electrode 9 comes out of contact with the developer so that the first circuit is in the off state. Thus, it can be automatically recognized that the circulating system is operating in a normal state. In this case, the degree of lowering of the liquid level of the branch pipe 7 is determined by factors such as the sucking force of the circulating pump, the atmospheric pressure head, the internal diameter of the branch pipe 7, and therefore those factors are previously experimentally obtained so as to determined the height of the electrodes 9 and 10. In that case, when the circulating pump is normally operated so as to circulate a predetermined quantity of the circulating liquid, the level of the developer in the branch pipe 7 is in a state as shown in FIG. 2B and the second electrode 10 is in contact with the liquid, so that the second circuit is in the on-state. Accordingly, the fact that the system is in its normal state can be recognized from the state in which the first circuit is in its off-state and the second circuit $C_2$ is in its on-state.

Figure 2C:
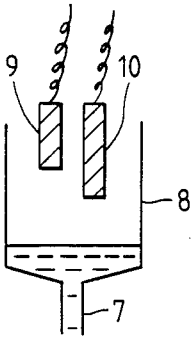

In the case where circulation of the liquid is stopped or made slow because of a malfunction or fault of the pump, blockage of the circulation piping system, or the like, even if a pump power source is turned on, the developer in the branch pipe 7 is in the state shown in FIG. 2A so that each of the first and second circuits $C_1$ and $C_2$ is in its on-state. In the case where the quantity liquid poured by the circulating pump is abnormally increased or the liquid level of the developer in the developing tank is abnormally lowered because of a malfunction fault of the replenishing pump, or the like, the level of the developer in the branch pipe is further lowered as shown in FIG. 2C, so that both the first and second circuits $C_1$ and $C_2$ are turned off.

In the above-described operation, the currents flowing through the first and second circuits $C_1$ and $C_2$ are detected by amperemeters $A_1$ and $A_2$ which are adapted to output signals through lines 12 and 13 to an interface 14 and a control unit 15. The control unit 15 in turn outputs a suitable signal through a line 16 to drive a pump 3. The circuits themselves are well known in the art.

Figure 1B:
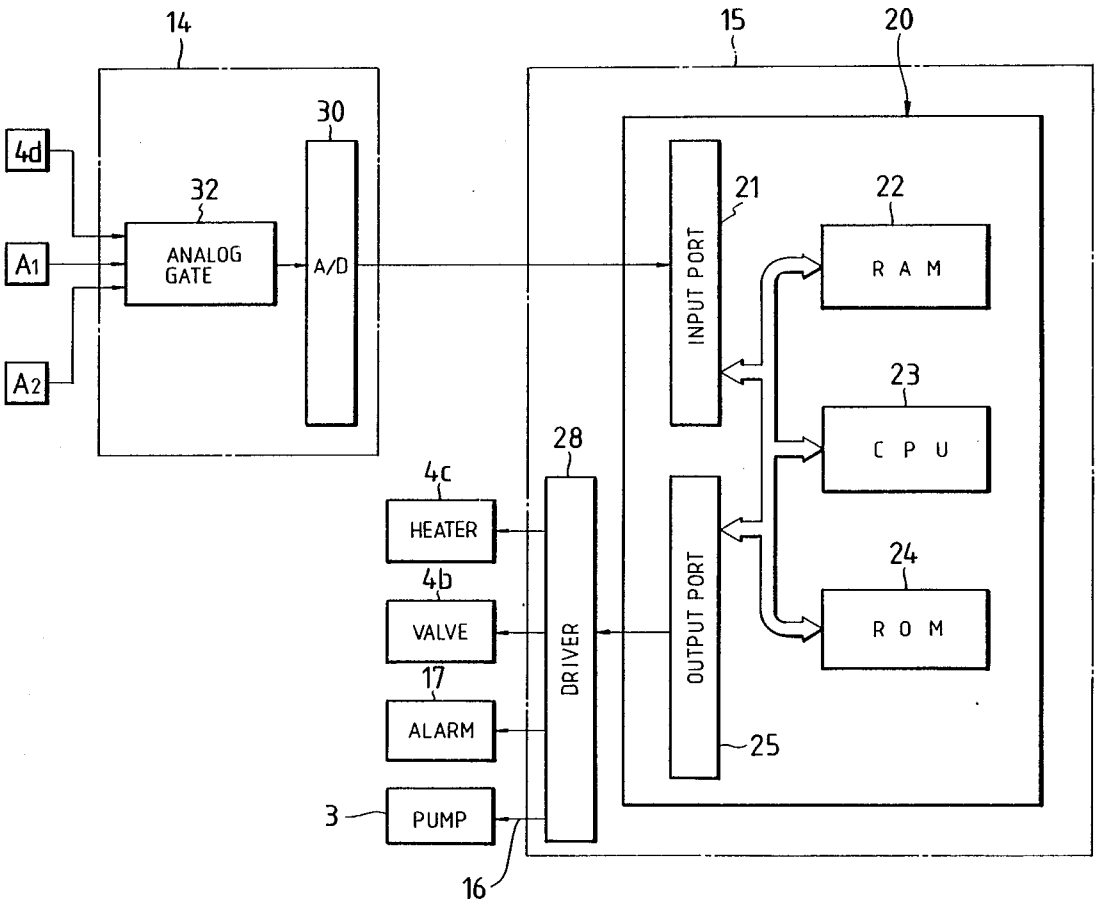

As shown in FIG. 1B, the control unit 15 includes a microcomputer 20 constituted by an RAM 22, a CPU, an ROM 24, an input port 21 and an output port 25, and a driver 28. The interface includes an analog gate 32 and an A/D converter. The output signals of the ammeters $A_1$ and $A_2$ are supplied to the A/D converter via the analog gate 32. The signals of the temperature detecting sensor **4*d* are also supplied to the A/D converter through the analog gate 32. The output signals of the A/D converter 30 are supplied to the input terminal of the input port 21 of the microcomputer 20. The heater 4*c*, the valve 4*b*, the alarm means 17 and the pump 3 are connected to the corresponding output terminal of the driver 28. Based on the arithmetic expressions stored in advance in the ROM 24, the CPU 23 of the microcomputer 20 determines as to whether the liquid level and the temperature of circulating liquid are normal, and whether the sensor constituted by a plurality of the electrodes, the pump 3 and the heater 4*c*** are properly operated.

Figure 3:
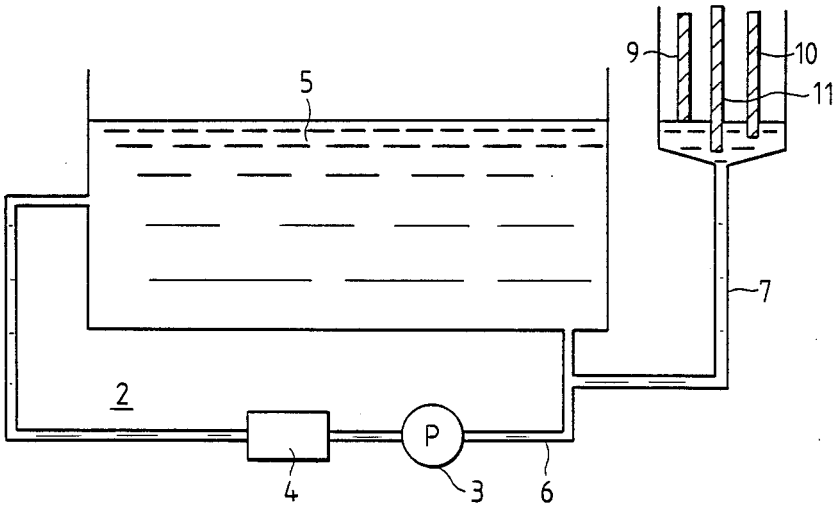

FIG. 3 is a schematic view showing another embodiment of the present invention, in which a common electrode 11 is provided so as to come into contact with a processing liquid in a branch pipe 7. In the drawing, the common electrode 11 is inserted to a position even with or a little deeper than a second liquid level detecting electrode 10. The operation of the electrodes 9 and 10 due to the operation of a circulating pump 3 is the same as the operation shown in FIGS. 2A, 2B and 2C, and therefore the description will be omitted.

Accordingly, the state of the circulating system can be automatically detected by means of the combination of the existence of an operational command to the circulating pump and the state of both the circuits, in such a manner as shown in the following table, so that a fault or the like can be suitably coped with and a user of the automatic processing machine can be informed by means of alarm/display 17.

| Pump Actuation Command | 1st Circuit | 2nd Circuit | Example of detectable state |
|---|---|---|---|
| NON | ON | ON | Level is normal |
| NON | ON | OFF | Sensor system is abnormal |
| NON | OFF | ON | Level is low slightly |
| NON | OFF | OFF | Level is low |
| YES | ON | ON | Circulation pump system is abnormal |
| YES | OFF | ON | Both circulation system and level are normal |
| YES | ON | OFF | Sensor system is abnormal |
| YES | OFF | OFF | Level is insufficient |

Figure 4:
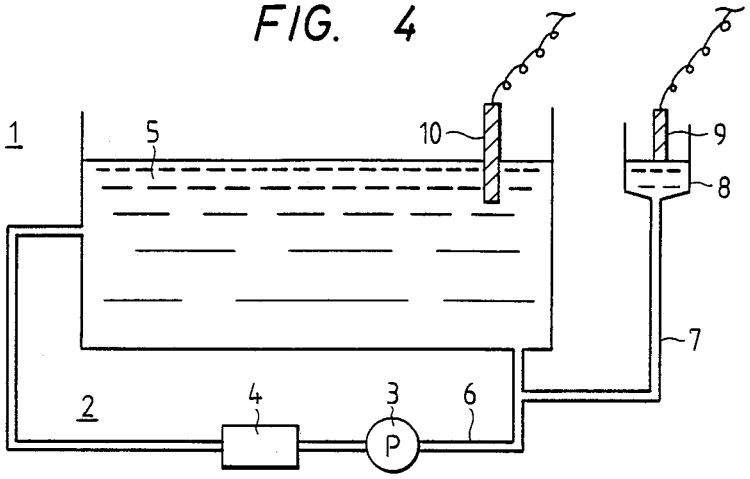

FIG. 4 shows another embodiment of the invention in which the same reference numerals are used to denote the like component. In FIG. 4, a branch pipe 7 opened slightly above the level of the developer is vertically provided on a pipe 6 provided on the upstream side through which the developer in the circulating system enters the pump 3 (that is, a suction side pipe). Preferably the diameter of an opening portion 8 of the branch pipe 7 is enlarged. A level detecting electrode 9 is provided in the opening portion 8 so that the lower end of the electrode 9 is positioned in the same plane as or slightly lower than the liquid level in the developing tank 1. A contact electrode 10 is provided so that the lower end of the electrode 10 is dipped in the developing liquid in the developing tank 1.

In the state where the pump is stopped, a part of the developing liquid enters the branch pipe 7 and the liquid level in the branch pipe 7 is even with the liquid level in the developing tank, and therefore if a current is caused to flow across the electrodes, the circuit is turned on.

Figure 5A:
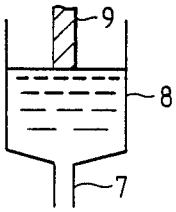

If the circulating pump 3 is driven, the liquid in the pipe 6 is sucked by the circulating pump, so that the liquid level in the branch pipe 7 is lowered by the sucking pressure of the circulating pump. The degree of lowering of the liquid level varies depending on a difference between the sucking force of the circulating pump and the atmospheric pressure head, the internal diameter of the branch pipe, or the like. Thus, when the circulating pump 3 is actuated to operate normally, the state of FIG. 5A is changed into the state of FIG. 5B, so that the electrode 9 comes off from the surface of the developer in the branch pipe and the circuit is turned off.

Figure 5B:
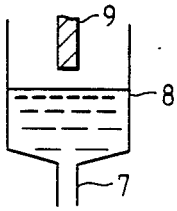

If the liquid is normally circulated, the liquid level in the branch pipe is in the state of FIG. 5B, and therefore the circuit across the electrodes is in an off-state. If this state is detected by detecting means and displayed by displaying means, it can be automatically recognized that the circulating system is normal.

In this state, if the liquid stops circulating or becomes weak, because of a fault or malfunction in the pump, blockage of the circulating system, or the like, the liquid level in the branch pipe is raised, so that the surface of the liquid comes into contact with the lower end of the electrode 9 and the circuit is turned on. Accordingly, the abnormality of the liquid circulation can be automatically recognized.

Further, if the depth of the contact electrode 10 from the liquid level is selected to be a predetermined value, in the case where the level of the developer comes down abnormally (for example, in the case of insufficiency of the replenishing liquid, leakage of liquid from the tank, or the like), the abnormality can be detected before the pump is operated, so that the heater can be prevented from overheating (prevention of so-called "empty-tank burning") and an user of the autmocatic processing machine can be informed of the abnormality by means of an error display or a buzzer sound.

Figure 6:
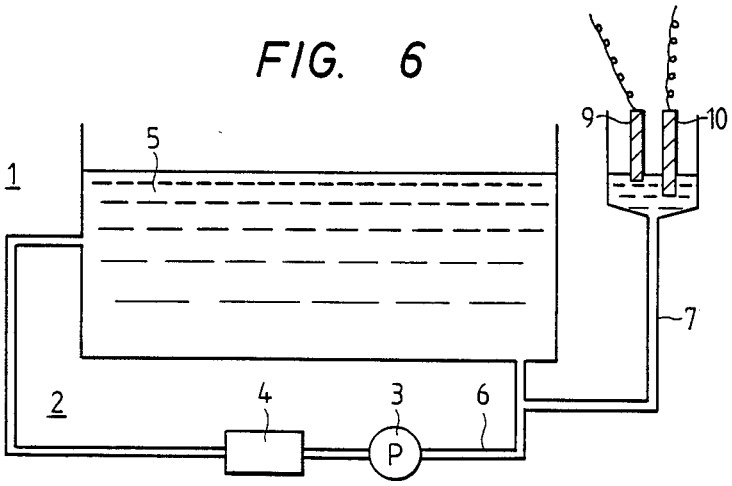

FIG. 6 is a schematic view showing another embodiment of the present invention. In this case, the contact electrode 10 is provided so as to come into contact with the processing liquid in the branch pipe 7. In the drawing, the contact electrode 10 is inserted into the treatment liquid in the branch pipe 7 to a position substantially same as or a little deeper than the level detecting electrode 9. The operation of the electrode 9 in accordance with a change in liquid level owing to the operation of a circulating pump 3 is the same as the operation shown in FIGS. 5A and 5B, and therefore the description will be omitted.

Althought the case where the present invention is applied to the developing tank of the automatic processing machine has been described by way of example, it is apparent that the present invention is not limited only to such an embodiment but is applied to any processing tanks.

According to the present invention, it can be automatically detected whether the circulation of the processing liquid in each processing tank of the automatic processing machine is normal or abnormal.

We claim:

1. An apparatus for detecting circulating liquid flow in a machine for automatically processing a photographic light-sensitive element, comprising:

a processing tank for containing a processing liquid;

a processing liquid circulating means, provided outside said processing tank, for circulating a part of the processing liquid in said processing tank;

a branch pipe means having an opening portion at one end opened at a position higher than a liquid level of the processing liquid, said branch pipe means being vertically disposed and having the other end connected to a pipe which extends between a lower portion of said processing tank and a suction side of said processing liquid circulating means such that the liquid in said branch pipe means is directly responsive to operation of said circulating means;

a first liquid level detecting electrode provided in said opening portion so that a lower end of said first electrode is positioned on the same level as or a position a little lower than the liquid level of said processing tank;

a second liquid level detecting electrode provided so that a lower end of said second electrode is positioned on the same level as or a little lower than a position where the liquid level in said branch pipe is lowered when said circulating means is driven; and a common electrode provided so as to be in contact with the processing liquid.

2. The apparatus according to claim 1, wherein said common electrode is provided so as to be in contact with the processing liquid in said processing tank.

3. The apparatus according to claim 1, wherein said common electrode is provided so as to be in contact with the processing liquid is said branch pipe.

4. The apparatus according to claim 1, wherein said processing liquid circulating means comprises a circulating pump.

5. An apparatus for detecting circulating liquid flow in a machine for automatically processing a photographic light-sensitive material, comprising:

a processing tank for containing a processing liquid;

a processing liquid circulating means, provided outside a processing tank, for circulating the processing liquid in said processing tank;

a branch pipe means having an opening portion at one end opened at a position higher than a liquid level of the processing liquid, said branch pipe means being vertically disposed and having the other end connected to a pipe which extends between a lower portion of said processing tank and a suction side of said processing liquid circulating means such that the liquid in said branch pipe means is directly responsive to operation of said circulating means;

a liquid level detecting electrode provided in said opening portion so that a lower end of said electrode is positioned on the same level as or a position a little lower than the liquid level of said processing tank; and a contact electrode is provided so as to be in contact with the processing liquid.

6. The apparatus according to claim 5, wherein said contact electrode is provided so as to be in contact with the processing liquid in said processing tank.

7. The apparatus according to claim 5, wherein said contact electrode is provided so as to be in contact with the processing liquid in said branch pipe.

8. The apparatus according to claim 5, wherein said processing liquid circulating means comprises a circulating pump.

9. An apparatus for detecting circulating liquid flow in a machine for automatically processing a photographic light-sensitive element, comprising:

a processing tank for containing a processing liquid;

a processing liquid circulating means, provided outside said processing tank, for circulating a part of the processing liquid in said processing tank;

a branch pipe means opened at a position higher than a liquid level of the processing liquid, said branch pipe means being vertically provided on a suction side of said processing liquid circulating means;

a first liquid level detecting electrode provided in said opening portion so that a lower end of said first electrode is positioned on the same level as or a position a little lower than the liquid level of said processing tank;

a second liquid level detecting electrode provided so that a lower end of said second electrode is positioned on the same level as or a little lower than a position where the liquid level in said branch pipe is lowered when said circulating means is driven;

a common electrode provided so as to be in contact with the processing liquid; and wherein said common electrode is provided so as to be in contact with the processing liquid in said processing tank.

10. An apparatus for detecting circulating liquid flow in a machine for automatically processing a photographic light-sensitive material, comprising:

a processing tank for containing a processing liquid;

a processing liquid circulating means, provided outside a processing tank, for circulating the processing liquid in said processing tank;

a branch pipe means opened at a position higher than a liquid level of the processing liquid, said branch pipe means being vertically provided on a suction side of said processing liquid circulating means;

a liquid level detecting electrode provided in said opening portion so that a lower end of said electrode is positioned on the same level as or a position a little lower than the liquid level of said processing tank;

a contact electrode is provided so as to be in contact with the processing liquid; and wherein said contact electrode is provided so as to be in contact with the processing liquid in said processing tank.

* * * * *